US005130063A

United States Patent [19]

Collins et al.

[11] Patent Number: 5,130,063

[45] Date of Patent: Jul. 14, 1992

[54] WATER DISTRIBUTION APPARATUS FOR AN EVAPORATIVE COOLER

[76] Inventors: Harold O. Collins, 7551 E. North La., Scottsdale, Ariz. 85258; James J. Hennessy, 3632 W. Pecan Rd., Phoenix, Ariz. 85041

[21] Appl. No.: 750,065

[22] Filed: Aug. 26, 1991

[51] Int. Cl.[5] ..... B01F 3/04

[52] U.S. Cl. ..... 261/106

[58] Field of Search ..... 261/106, 98

[56] References Cited

U.S. PATENT DOCUMENTS 4,031,180 6/1977 Bohanon ..... 261/106

4,428,890 1/1984 Harrell ..... 261/106

4,657,709 4/1987 Goettl ..... 261/106

*Primary Examiner*—Tim Miles

*Attorney, Agent, or Firm*—H. Gordon Shields

[57] ABSTRACT

Water distribution apparatus for an evaporative medium in the evaporative cooler includes a single molded element which is disposed on the top of an evaporative medium. The water distribution apparatus contacts the four sides of the evaporative medium at the top of the evaporative medium and is sealed to both the top of the evaporative medium and to the top of the evaporative cooler housing in which the apparatus is disposed to prevent air loss around the apparatus and accordingly to insure that air flow is through the evaporative medium. A water distribution tube is disposed within a central water deflection element in the apparatus, and water from the tube falls onto the top of the evaporative medium.

11 Claims, 2 Drawing Sheets

WATER IN
AIR FLOW

WATER IN
AIR FLOW

WATER DISTRIBUTION APPARATUS FOR AN EVAPORATIVE COOLER

BACKGROUND OF THE INVENTION

1. Field of the Invention

This invention relates to evaporative coolers and, more particularly, to a water distribution system for an evaporative cooler.

2. Description of the Prior Art

Evaporative apparatus is well known in the drier parts of not only the United States, but other dry countries in which the heated evaporization is used to cool air. That is, hot, dry air is pulled through a medium which is saturated with moisture and the hot, dry air is cooled and humidified in the process of evaporating moisture from the water saturated medium.

Of primary importance is the saturation of the medium with the water. That is, it is desired that the evaporative cooling medium be kept saturated, but in order to maximize the efficiency of the process and minimize the amount of waste water involved, the evaporative cooling medium should be kept properly moistened and air should be drawn only through the evaporative medium, and not through cracks or other openings between the evaporative medium and a housing disposed about it.

An inherent problem in most water distribution systems, if they are made of metal, is corrosion, rust, and the like. Moreover, with metal, the metal must be fabricated, which includes welds, bends, etc., all of which may result in, eventually, the possibility of air leaking through, and water leaking out, all due to various circumstances. The circumstances, of course, include vibration, corrosion, rust, cracks or other openings, and the like.

The apparatus of the present invention comprises a water distribution system in which a primary element is molded of plastic and which includes specific elements for connecting to an appropriate water source. In the prior art, the connection to a water source has been a problem because of the connection to the metal housing, the sealing of the water connection to the metal housing, and the suspension of a water distribution manifold within the housing. The apparatus of the present invention overcomes these particular problems by securing a water distribution water manifold to opposite ends of the housing and by molding a connector element directly to the housing as an integral part thereof.

SUMMARY OF THE INVENTION

The apparatus as described herein comprises a water distribution system which comprises a housing with integral end plates, all molded in a single piece, for connecting the housing to a supporting evaporative cooling structure and for supporting within the housing a water distribution manifold. A water connection boss is molded also as an integral part of the housing. Also included, and again molded as an integral part of the housing, is a support boss for preventing the housing from moving away from the evaporative cooler pads on which the housing is disposed.

Among the objects of the present invention are the following:

To provide new and useful water distribution apparatus for an evaporative cooler;

To provide new and useful water distribution apparatus including a molded plastic housing;

To provide new and useful water distribution element for an evaporative cooler supported at its opposite ends by a housing by which it is disposed;

To provide new and useful evaporative cooling water distribution system including a water distribution manifold mounted within a water distribution housing; and To provide new and useful water distribution apparatus disposed on and supported by an evaporative cooling medium and secured to an evaporative cooler housing.

DESCRIPTION OF THE PREFERRED EMBODIMENT

Figures 1, 2, 3, 4, 5:
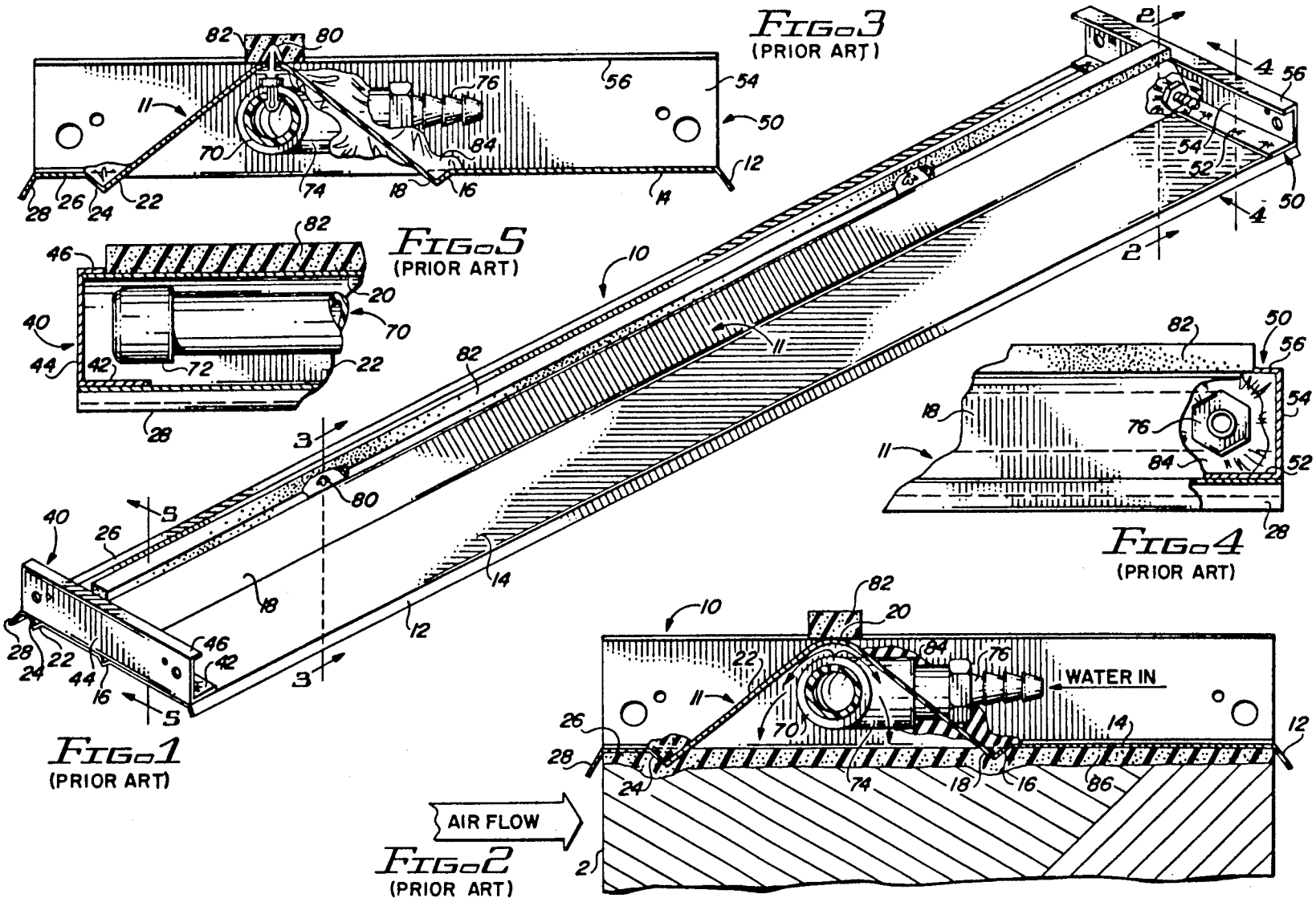
FIG. 1 (PRIOR ART)
FIG. 2 (PRIOR ART)
FIG. 3 (PRIOR ART)
FIG. 4 (PRIOR ART)
FIG. 5 (PRIOR ART)
FIG. 1 is a perspective view of the prior art involved in the apparatus of the present invention.
FIG. 2 is a view in partial section of the apparatus of FIG. 1 in its use environment taken generally along line 2—2 of FIG. 1.
FIG. 3 is a view in partial section taken generally along line 3—3 of FIG. 1.
FIG. 4 is a view in partial section taken generally along line 4—4 of FIG. 1.
FIG. 5 is a view in partial section taken generally along line 5—5 of FIG. 1.

A prior art water distribution apparatus 10 for evaporative cooler systems is shown in FIGS. 1, 2, 3, 4, and 5. FIG. 1 is a perspective view of prior art water distribution apparatus 10, which is made of sheet metal. Details of the apparatus 10 are shown in FIGS. 2, 3, 4, and 5. The distribution apparatus 10 is shown in place on an evaporative medium 2 in FIG. 2. FIG. 2 is a view in partial section taken generally along line 2—2 of FIG. 1. The distribution apparatus 10 is disposed on top of and fits on, the medium 2.

The distribution apparatus 10 includes an upwardly extending center element 11 and a pair of elements extending outwardly from the center element. One outer element includes a relatively short outer flange 12 which extends downwardly and outwardly along the side of, but outwardly from, the medium 2. The flange 12 may be considered as an inside flange, because it is on the inside of an evaporative cooler housing, and on the lee side of the medium 2 with respect to the air flow. The air flow through the medium 2 is illustrated by a relatively large arrow in FIG. 2.

Extending horizontally inwardly from the outer vertical flange 12 is a horizontally extending flange 14. The flange 14 is disposed on the top of a foam pad 4 which is disposed on top of the medium 2.

Remote from the outer flange 12, there is relatively short downwardly angled minor flange 16. The flange 16 extends downwardly only a relatively short distance.

Then, from the bottom of the flange 16, remote from the horizontal flange 14, there is an upwardly extending major angled flange 18. A top bend 20 extends from the top of the flange 18. A downwardly extending major angled flange 22 extends downwardly from the top bend 20. The flanges 18 and 22 are symmetrical, as shown in FIGS. 2 and 3.

From the bottom of the flange 22, there is a relatively short upwardly extending minor flange 24. The flanges 24 and 16 are symmetrical with respect to each other and with respect to the major flanges 18 and 22.

From the upper portion of the flange 24, remote from the flange 22, there is a relatively short horizontally extending flange 26. The flange 26 is aligned with the flange 14.

From the outer edge of the horizontal flange 26, remote from the flange 24, there is a downwardly and outwardly extending relatively short outer flange 28. The flange 28 extends outwardly from the outside of the medium 2.

One of the inherent problems with the flanges 12 and 28 is that they do not contact the evaporative medium 2. With the outward flare of the flanges 12 and 28, water may migrate or flow down the inside of the flanges and drop directly downwardly from the bottom edges of the flanges. From the flange 12, such free falling water droplets may be entrained in the cooled flow of air and thence into the blower system, duct work, etc. From the flange 28, the water droplets may contact the inlet grill panel and migrate to the outside of the cooler apparatus and cause mineral stains and water loss.

The apparatus of the present invention overcomes this problem by having the comparable flanges in direct contact with the evaporative medium.

A pair of end brackets 40 and 50 are secured to the outer ends of the horizontal flange 14 and 26. The end brackets 40 and 50 are mirror images of each other. The bracket 40 includes a horizontal flange 42, a vertical web 44 and a horizontal top flange 46. The flanges 42 and 46 are generally parallel to each other. The bottom flange 42 is appropriately spot welded to the flanges 14 and 26.

The bracket 50, as indicated above, is virtually the mirror image of the bracket 40. It includes a horizontal bottom flange 52, a vertical web 54 and a horizontal top flange 56. The flanges 52 and 56 are generally parallel to each other. The flange 52 is appropriately secured, as by spot welding, to the horizontal flanges 14 and 26 of the center element.

The vertical webs 44 and 54 of the brackets 40 and 50, respectively, include a plurality of apertures extending through them. The apertures are to secure the apparatus 10 to the outer end walls of an evaporative cooler housing (not shown).

Within the center element 11 of the apparatus 10 is a plastic water line or manifold 70. Details of the manifold 70 are illustrated in FIGS. 2, 3, 4, and 5.

FIG. 3 is a view in partial section of the apparatus 10 taken generally along line 3—3 of FIG. 1. FIG. 4 is a view in partial section of a portion of the apparatus 10 taken along line 4—4 of FIG. 1. FIG. 5 is a view in partial section of another portion of the apparatus 10 taken generally along line 5—5 of FIG. 1. For the following discussion, reference will be made to all five of the figures.

The plastic water manifold 70 is merely a length of plastic pipe disposed within the center element 11. The manifold 70 includes an end cap 72 which seals the end of the pipe 70 adjacent to the bracket 40. At the opposite end of the manifold or pipe 70 there is an elbow 74. The elbow 74 extends outwardly through a hole or aperture in the angled flange 18 of the center element 11. A hose connector 76 is secured to the elbow 74. The elbow 74 and water connection 76 are appropriately sealed in the aperture in the flange 18 by sealing putty 84.

A water hose or tubing (not shown) is appropriately secured to the hose connection element 76.

For supporting the manifold or pipe 70 within the center element 11, there is a plurality of support hangers 80. The support hangers 80, as best shown in FIG. 3, extend through the pipe 70 in apertures drilled for the purpose of receiving the hangers 80. The hangers 80 in turn extend upwardly through the top bend 20. The hangers 80, with their holes in both the pipe 70 and in the top bend 20, are appropriately spaced apart along the length of the center element 11.

To prevent water leakage through the apertures in the top bend 20 through which the hangers 20 extend, sealing material, such as the sealing putty 84, is used. The sealing putty material is generally effective, but any water that does migrate through any of the apertures is soaked up by a foam sealing strip 82. The strip 82 is discussed below.

The water that is soaked up by the foam strip 82 migrates to the end brackets 40 and 50 and then seeps outside the evaporative cooler housing. The water causes staining from the mineral deposits in the water.

The apparatus of the present invention overcomes this problem by utilizing a different suspension system for the water manifold. That is, a different design water manifold is utilized in the apparatus of the present invention.

On top of the bend 20 is the cushion and sealing strip 82. The cushion and sealing strip 82 serves primarily as an air seal to prevent air form going over the evaporative medium 2 instead of through the medium. A second function of the strip 82 is to act as a cushion between the top bend 20 of the center element 11 and the top of the evaporative cooler housing (not shown) in which the medium 2 and the water distribution apparatus 10 is disposed.

However, the foam strip 82 also acts as a sponge and water conduit for water which migrates through the apertures in which the support anchors 80 are disposed and past the sealing putty, such as the putty 84 (see FIGS. 2 and 4) that is used to seal the apertures and the support anchors. The water migrates along the foam strip 82 to the end brackets 40 and 50 and through the apertures as along the screw fasteners which extend through the apertures in the brackets to secure the brackets and the water distribution apparatus 10 to the evaporative cooler housing. The water then runs (flows) down the housing and stains the outside of the housing. The stains, of course, detract from the appearance of the apparatus and can also have a deleterious effect on both the evaporative cooler and the roof on which the evaporative cooler apparatus is disposed.

Another foam layer 86 is disposed on top of the medium 2, and the apparatus 10 is disposed on the foam layer 86. The foam layer 86 also acts as a seal between the apparatus 10 and the evaporative medium 2 to help insure that the airflow is through the medium 2.

Figures 6, 7, 8, 9, 10, 11:
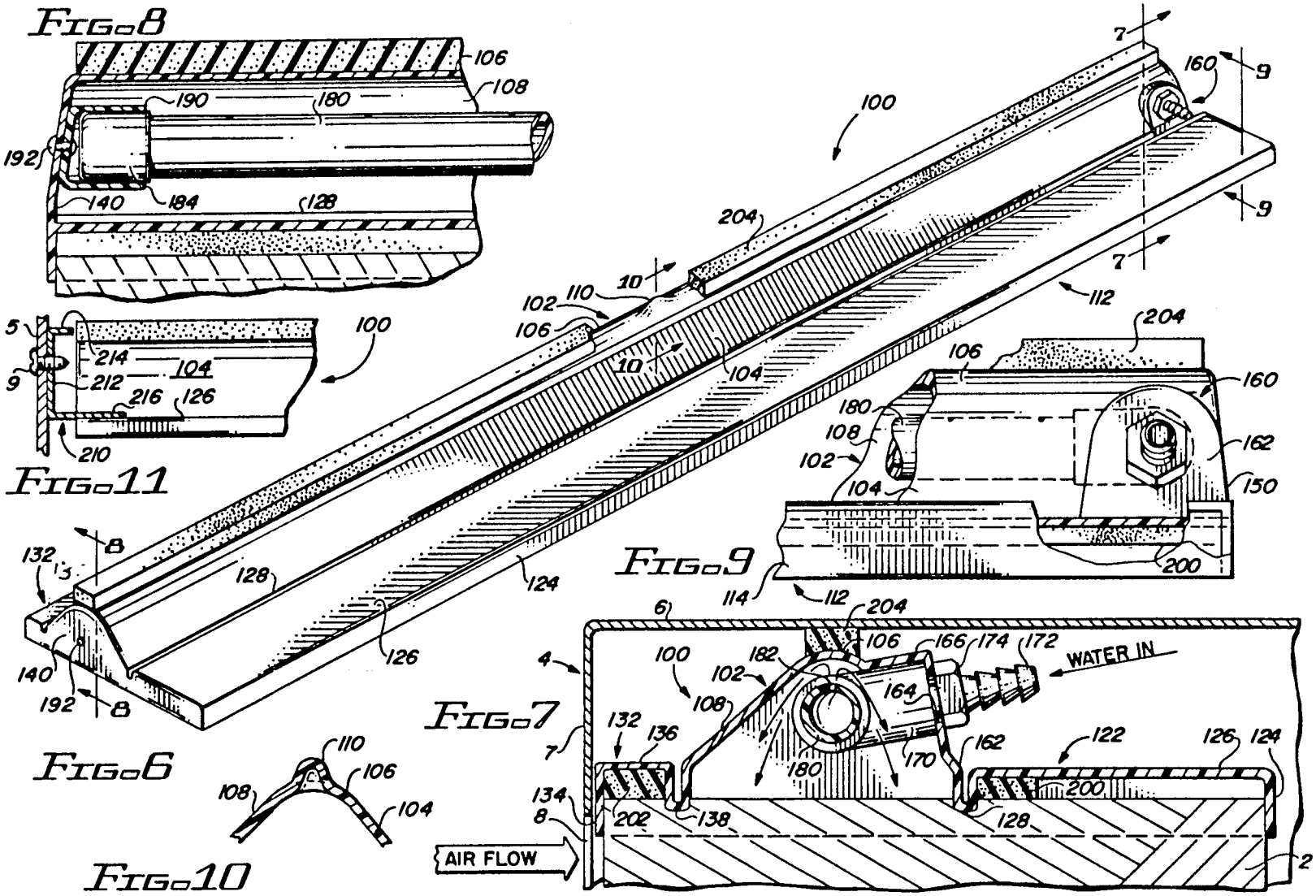
FIG. 6 is a perspective view of the apparatus of the present invention.
FIG. 7 is a view in partial section of the apparatus of FIG. 6 taken generally along line 7—7 of FIG. 1.
FIG. 8 is a view in partial section of the apparatus of FIG. 6 taken generally along line 8—8 of FIG. 6.
FIG. 9 is a view in partial section taken generally along line 9—9 of FIG. 6.
FIG. 10 is a view in partial section taken generally along line 10—10 of FIG. 6.
FIG. 11 is a view in partial section of a portion of the apparatus of the present invention.

FIG. 6, 7, 8, 9, 10 and 11, comprise illustrations of the apparatus of the present invention. FIG. 6 is a perspective view of water distribution apparatus 100 of the present invention in its use environment.

The use environment of the apparatus 100 comprises an evaporative cooler 4. The cooler 4 includes a top panel 6, a front panel 7, and a front opening 8 in the front panel 7.

The apparatus 100 is disposed adjacent to the top panel 6 and the front panel 7. The opening 8 is the air intake opening, as indicated by the relatively large arrow. The evaporative medium 2 is disposed adjacent to the opening 8, and the water distribution apparatus 100 is disposed on the top of the evaporative medium 2.

FIG. 7 is a view in partial section of the apparatus 100 taken generally along line 7—7 of FIG. 6. FIG. 8 is a view in partial section of a portion of the apparatus 100 taken generally along line 8—8 of FIG. 6. FIG. 9 is a front view in partial section of a portion of the apparatus 100 taken generally along line 9—9 of FIG. 6. FIG. 10 is a view in partial section of a portion of the apparatus 100 taken generally along line 10—10 of FIG. 6. For the following discussion, reference will generally be made to FIGS. 6, 7, 8, 9, and 10.

The water distribution apparatus 10 includes a water deflection central element 102 which generally includes three primary portions, a sloping side 104, a curved top 106, and a sloping side 108. The sides 104 and 106 extend downwardly and outwardly from the curved top 106. Extending upwardly from the curved top 106 are a plurality of spaced apart raised bumps or protuberances 110. The protuberance 110 is shown in detail in FIG. 10.

Extending outwardly from the sloping side 104 is an outer top element 122. The outer top element 122 includes an outer vertical flange 124 and top horizontal flange 126, and a U-bend 128. The vertical flange 124 comprises a flange which extends downwardly along side of the upper portion of the evaporative medium 2. From the top of the vertical flange 124, the horizontally extending flange 126 extends inwardly toward the sloping side 104. The horizontal flange 126 is connected to the sloping side 104 by a U-bend 128. The U-bend 128 extends downwardly from both the sloping side 104 and the horizontal flange 126. As best shown in FIG. 7, the U-bend 128 extends downwardly into the top portion of the evaporative medium 2. Extending outwardly from the sloping side 108 is another outer top element 132. The top element 132 includes a vertical flange 134, a top horizontally extending flange 136, and a U-bend 138.

The flange 126 and 136 are generally flat or planar. They extend the full length of the apparatus 100, as best shown in FIG. 7.

The vertical flange 134 is generally parallel to the flange 124. Like the flange 124, the flange 134 extends downwardly along the side of the evaporative medium 2. The top horizontal flange 136 is disposed generally perpendicular to the vertical flange 134, just as the top horizontal flange 126 is generally perpendicular to the vertical flange 124. Between the horizontal flange 136 and the sloping side 108 is the U-bend 138. The U-bend 138 is generally parallel and substantially identical, to the U-bend 128.

From both FIGS. 6 and 7, it is obvious that the outer top element 122 has a greater width than does the top element 132. The top element 132 is on the upstream or air intake side of the water distribution apparatus 100, and the top element 122 is on the downstream or lee side of the evaporative medium 2. This structural arrangement locates the water deflector center element 102 off center with respect the evaporative medium 2, and generally on the upstream side of the air intake. In other words, the water is distributed off center with respect to the evaporative medium 2, and generally toward the air intake side of the medium 2.

An end wall 140 closes one end of the apparatus 100, and the end 140 is generally perpendicular to the flange 124, 126, and 134, 136.

As best shown in FIG. 8, there may be a slight inward curve or draft to the upper portion of the end wall 140. The draft at the center portion of the end wall 140, and adjacent to the curved top 106, is preferably at a maximum of about three degrees.

At the opposite end of the apparatus 100 from the end wall 140 is an end wall 150. The end wall 150 is substantially identical to, or generally the mirror image of, the end wall 140. It similarly may include an inward and upward draft, as best shown in FIG. 9. In both FIGS. 9 and 8, the slope of the end walls, or the draft of the end walls, is exaggerated slightly for illustrative purposes.

Adjacent to the end wall 150, and extending outwardly from the sloping side 104, is a water input gable 160. The water input gable 160 includes a front wall 162 which extends upwardly from adjacent to the U-bend 128. An aperture 164 extends through the wall 162. A top wall 166 extends between the sloping side 104 and the front wall 162.

The front wall 162 has a tilt of about ten degrees from vertical towards the wall 104. While the wall 162 is flat, for convenience in securing a hose adapter 172 thereto, there is about a ten degree slope from the vertical and towards the sloping side 104, or specifically towards the top 106. The tilt insures that the hose adapter 172 includes an upward tilt.

Disposed within the water deflector element 102 is an elbow 170. The hose adapter 172 extends through the aperture 164 and is connected to the elbow 170. The elbow 170 is accordingly disposed at the water input gable 160. The adaptor 172 and elbow 170 are secured to the front wall 162 of the water input gable 160 by a nut 174.

Extending axially within the water deflector element 102 is a water distribution tube 180. The elbow 170 is connected to one end of the water distribution tube 180. The opposite end of the water distribution tube is closed by an end cap 184. The end cap 184 extends into a sleeve 190. The sleeve is appropriately secured to the end wall 140 of the water deflector center element 102. In FIG. 8, a plastic rivet 192 is shown as a securing element between the sleeve 190 and the end wall 140.

A plurality of holes or aperture 182 extends through the water distribution tube 180 in a spaced apart relationship along the length of the tube 180. Water flowing into the tube 180 through the hose adapter 172 flows out of the tube 180 through the plurality of holes 182. As best shown in FIG. 7, the water is sprayed upwardly onto the curved top 106 of the deflector element 102 and flows downwardly along the sloping sides 104 and 108 and onto the evaporative medium 102.

A pair of foam strips 200 and 202 are used to appropriately seal the apparatus 100 with respect to the evaporative medium 2. The foam strip 200 is disposed on top of the evaporative medium 2 adjacent to the U-bend 128 and beneath the horizontal flange 126. The foam strip 202 is also disposed on top of the evaporative medium 2 and is disposed adjacent to the vertical flange 134 and the U-bend 138 and beneath the horizontal flange 136. The weight of the apparatus 100 serves to compress the foam elements 200 and 202 to insure an airtight seal between the apparatus 100 and the evaporative medium 2.

A third foam strip 204 is disposed on the top of the curved top portion 106 of the water deflector element 102. The foam strip 204 serves as a seal between the water deflector element 102 and a top 6 of the evaporative cooler housing 4 in which the evaporative medium 2 and the apparatus 100 is disposed. The raised bumps or protuberances 110 help to hold the foam strip 204 in place and to insure a good seal between the deflector element 102 and the evaporative cooler housing top 6. Note that there is nowhere for water to contact the foam strip 204 since there are no holes or openings in the top 106 of the center element 102.

Obviously, it is highly desirable that the air flow through the evaporative cooler apparatus 4 be directed through the evaporative medium 2. Accordingly, the foam strip 204 is used to seal the water distribution apparatus 100 from the top 6 of the evaporative cooler housing 4, and the foam strips 200 and 202 are used to seal the top of the medium 2 from the water distribution manifold apparatus 100. Specifically, the foam strips 200 and 202 provide a seal between the top of the evaporative medium 2 and the outer top element 122 and the outer top element 132, respectively. The incoming air is accordingly forced to go through the medium 2 rather than either up and over the water distribution apparatus 100 or between the water distribution apparatus 100 and the medium 2. Maximum efficiency of the air flow is accordingly achieved.

Referring specifically to FIG. 8, there is essentially a double seal between the end wall 140 and the tube 180. The tube 180 is sealed by the end cap 184, and the end cap 184 is in turn disposed in a sleeve 190. The plastic rivet 192 is used to secure the sleeve 190 to the end wall 140. The double seal at the end of the tube 180 helps to insure that there is little, if any, water escaping through the end wall 140 from within the center element 102. No water, of course, leaks from the center element 102 from the end wall 150 since it is a completely sealed end wall. The tube 180 is secured to the central element 102 at the water input gable 160 to the elbow 170 and to the hose adapter or water connector 172 by the nut 174, as discussed above. Moreover, the upward tilt of the water input gable 160 substantially lessens the possibility of water escaping through any kind of a hole or aperture that may be disposed between the elbow 170, the front wall 162, and the nut 174 adjacent to the aperture 164. The upward tilt would cause any water to run backwardly or inwardly within the apparatus 100, rather than running outwardly.

As may be understood from FIG. 6, the apparatus 100 is preferably made of plastic and is preferably formed or molded in a one piece configuration. The one piece configuration provides only two openings, namely the aperture in the end wall 140 through which the plastic rivet 192 extends, and the aperture 164 in the front wall 162 of the water input gable 160. Those are essentially the only locations through which water may escape outwardly from the apparatus 100. Accordingly, substantially all the water from the apertures 182 in the tube 180 flows downwardly onto the top of the evaporative medium 2 for cooling purposes.

With the outer vertical flanges 124 and 134 extending vertically along side and in contact with the walls of the evaporative medium 2, no water escapes outwardly without going through the medium. The vertical flanges 124 and 134 are joined to the vertical bottom portions of the end walls 140 and 150 to similarly directly contact the evaporative medium 2 to again prevent any water from leaking outwardly away from the evaporative medium. Accordingly, the evaporative medium 2 is virtually clamped to the water distribution apparatus 100 to insure that water flow is limited to the evaporative medium 2.

FIG. 11 is a view in partial section of one end of the apparatus 100 and showing a bracket 210 secured to an end wall 5 of the evaporative housing 4. The bracket 210 includes outwardly extending flanges which are disposed on the tops of the horizontal flanges 126 and 136, respectively, of the outer top elements 122 and 132, respectively. One of the flanges, a flange 216, is shown in FIG. 17.

The bracket 210 includes a vertical web 212 which is disposed against the end wall 5 of the housing 4 by a plurality of fasteners, such as screws 9. The bracket 210 includes a top flange 214 which is disposed substantially perpendicularly to the vertical web 212. The bracket 210 also includes a pair of bottom flanges, one of which, a flange 216, is shown in FIGS. 11. The bottom flanges include a relatively wide bottom flange and a relatively narrow bottom flange. The bottom flange 216 is relatively wide so that it may be disposed on the relatively wide horizontal flange 126. Since the flange 136 is relatively narrow, it follows that the bottom flange for the bracket 210 will be relatively narrow.

As shown in FIG. 11, the flange 216 is merely disposed on top of the flange 126. There are no fastener elements between the flanges 126 and 216. The purpose of the bracket 210, and its bottom flanges, is simply to help steady the apparatus 100 on the evaporative medium 2, or to prevent the water distribution apparatus 100 from coming off the top of the evaporative medium 2 in use.

Since there are no holes or apertures which connect or secure the bracket 210 to the apparatus 100, the possiblity of water migrating from the apparatus 100 to the bracket 216, and outwardly through the apertures through which the screw 9 extends, is relatively small. This is, of course, contrasted with the prior art in which the water distribution apparatus 50 is connected directly to the evaporative cooler housing by screw elements, and accordingly the likelihood of water escaping from the water distribution apparatus 50 outwardly is virtually assured.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapated to specific environments and operative requirements without departing from those principles. The appended claims are intended to cover and embrace any and all such modifications, within the limits only of the true spirit and scope of the invention.

What we claim is:

1. Water distribution apparatus for distributing water to an evaporative medium in an evaporative cooler housing comprising, in combination:

water deflection means for deflecting water to the evaporative medium, including a top portion against which water may impinge, a first sloping portion extending downwardly and outwardly from the top portion on which water may run from the top portion, a second sloping portion extending downwardly and outwardly from the top portion and remote from the first sloping portion on which water may run from the top portion, a first generally horizontal portion extending outwardly from the first sloping portion, a first generally vertical flange extending downwardly from the first generally horizontal portion and disposed against the evaporative medium, a second generally horizontal portion extending outwardly from the second sloping portion, a second generally vertical flange extending downwardly from the second generally horizontal portion and disposed against the evaporative medium, a first end wall secured to and integral with the top portion, the first and second sloping portions, the first and second generally horizontal portions, and the first and second generally vertical flanges, and a second end wall remote from the first end wall and secured to and integral with the top portion, the first and second sloping portions, the first and second generally horizontal portions, and the first and second generally vertical flanges;

water distribution means disposed in the water deflection means for providing water for the water deflection means, including a water distribution tube for receiving a flow of water, a plurality of holes in the water distribution tube through which water flows to the water deflections means, and means for securing the tube to the water deflection means;

water supply means for providing water to the water distribution tube, including a water input gable integral with and extending outwardly from the first sloping portion, hose adapter means secured to the water input gable and to the water distribution tube and extending upwardly at an acute angle relative to the horizontal; and bracket means secured to the evaporative cooler housing and disposed on the first and second horizontal portions to hold the water deflections means in place relative to the evaporative medium and to the evaporative cooler housing.

2. The apparatus of claim 1 in which the bracket means includes a first portion disposed on the first generally horizontal portion and a second generally horizontal portion disposed on the second generally horizontal portion.

3. The apparatus of claim 2 in which the bracket means includes a first bracket and a second bracket, and each bracket includes a first and a second generally horizontal portion.

4. The apparatus of claim 1 in which the apparatus further includes first sealing means for sealing the water deflection means and the evaporative cooler housing for preventing the flow of air between the water deflection means and the evaporative cooler housing.

5. The apparatus of claim 4 in which the water deflection means includes protuberances for urging the first sealing means against the evaporative cooler housing.

6. The apparatus of claim 4 in which the apparatus further includes second sealing means between the evaporative medium and the first and second generally horizontal portions for preventing the flow of air between the evaporative medium and the water deflection means.

7. The apparatus of claim 1 in which the water supply means further includes a sloping front wall for the water input gable, and the hose adapter means extends through the sloping front wall.

8. The apparatus of claim 7 in which the sloping front wall of the water input gable slopes towards the top portion from the first sloping portion.

9. The apparatus of claim 1 in which the means for securing the tube to the water deflection means includes a sleeve secured to the first end wall.

10. The apparatus of claim 1 in which the water deflection means comprises a unitary molded element for distributing water only on the evaporative medium and for preventing water from contacting the evaporative cooler housing.

11. The apparatus of claim 1 in which the first generally horizontal portion has a first width between the first sloping portion and the first generally vertical flange, and the second generally horizontal portion has a second width between the second sloping portion and the second generally vertical flange, and the first width is greater than the second width.

* * * * *